US009054462B2

(12) United States Patent
Nickol

(10) Patent No.: US 9,054,462 B2
(45) Date of Patent: Jun. 9, 2015

(54) ELECTRIC CONNECTOR WITH A MULTIPART SHIELD

(75) Inventor: Marcell Nickol, Creuzburg/Scherbda (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 160 days.

(21) Appl. No.: 13/698,657

(22) PCT Filed: Jun. 1, 2011

(86) PCT No.: PCT/EP2011/059042

§ 371 (c)(1),
(2), (4) Date: Nov. 18, 2012

(87) PCT Pub. No.: WO2011/151373

PCT Pub. Date: Dec. 8, 2011

(65) Prior Publication Data

US 2013/0065438 A1 Mar. 14, 2013

(30) Foreign Application Priority Data

Jun. 2, 2010 (DE) ..... 10 2010 022 466

(51) Int. Cl.

| | |
|---|---|
| ***H01R 13/58*** | (2006.01) |
| ***H01R 13/6593*** | (2011.01) |
| ***H01R 9/03*** | (2006.01) |
| ***H01R 13/504*** | (2006.01) |

(52) U.S. Cl.

CPC ..... *H01R 13/6593* (2013.01); *Y10T 29/49176* (2015.01); *H01R 9/034* (2013.01); *H01R 13/504* (2013.01)

(58) Field of Classification Search

CPC ..... H01R 43/24
USPC ..... 439/578, 604, 607.51, 607.41, 607.58, 439/931, 88

See application file for complete search history.

(56) References Cited

U.S. PATENT DOCUMENTS

| | | | | |
|---|---|---|---|---|
| 4,634,208 | A | 1/1987 | Hall et al. | |
| 5,364,292 | A * | 11/1994 | Bethurum | 439/607.02 |
| 5,906,513 | A | 5/1999 | Peterson et al. | |

(Continued)

FOREIGN PATENT DOCUMENTS

| | | | |
|---|---|---|---|
| DE | 19613228 | A1 | 10/1997 |
| DE | 19613288 | A1 | 10/1997 |

(Continued)

*Primary Examiner* — Phuong Dinh

(74) *Attorney, Agent, or Firm* — Lawrence E. Laubscher, Sr.; Lawrence E. Laubscher, Jr.; Robert D. Spendlove

(57) ABSTRACT

An electrical connector having a generally tubular housing connects the conductors of an electrically-shielded cable with an electrical component, including a injection-molded electrically-conductive synthetic plastic bridge arrangement connecting the cable shield layer at a stripped end of the cable with a connector shield member arranged on the connector housing into one end of which the conductors are introduced. An injection-molded annular carrier layer of insulating synthetic plastic material is molded concentrically about the conductor ends, one end of the carrier layer extending within the conductive bridging layer, and the other end extending within the bore of the connector housing into which the conductor ends extend. Consequently, the connector is structurally reinforced to resist the forces and stresses of vibration and shock.

8 Claims, 3 Drawing Sheets

(56) References Cited

U.S. PATENT DOCUMENTS

| | | | | |
|---|---|---|---|---|
| 7,084,826 | B2 | 8/2006 | Aisenbrey | |
| 7,727,021 | B2 * | 6/2010 | Haruna et al. | 439/607.5 |
| 8,202,130 | B2 * | 6/2012 | Friese et al. | 439/736 |
| 2009/0269981 | A1 | 10/2009 | Haruna et al. | |

FOREIGN PATENT DOCUMENTS

| | | | |
|---|---|---|---|
| DE | 10338616 | A1 | 3/2005 |
| DE | 1000002008018403 | A1 | 10/2009 |
| EP | 2109194 | A2 | 10/2009 |

* cited by examiner

ELECTRIC CONNECTOR WITH A MULTIPART SHIELD

REFERENCE TO RELATED APPLICATIONS

This application is a continuation of the International Application No. PCT/EP2011/059042 filed Jun. 1, 2011, which is based on the German application No. DE 10 2010 02 466.9 filed Jun. 2, 2010.

BACKGROUND OF THE INVENTION

1. Field of the Invention

An electrical connector having a generally tubular housing connects the conductors of an electrically-shielded cable with an electrical component, including a injection-molded electrically-conductive synthetic plastic bridge arrangement connecting the cable shield layer at a stripped end of the cable with a connector shield member arranged on the connector housing into one end of which the conductors are introduced. An injection-molded annular carrier layer of insulating synthetic plastic material is molded concentrically about the conductor ends, one end of the carrier layer extending within the conductive bridging layer, and the other end extending within the bore of the connector housing into which the conductor ends extend.

2. Description of Related Art

Electrical conductors that are used for information transmission frequently have a shielding or screening arrangement, which, for example, consists of a wire braid that extends coaxially around the conductor. This shielding arrangement serves to provide protection against electromagnetic radiation and diminishes the error susceptibility of an information transmission along the transmission line. In order to ensure effective protection against electromagnetic radiation, the shielding must extend continuously from the transmitter via the conductor to the receiver. To connect the electrical conductor with an electrical subassembly, for example, the transmitter, the receiver, or another electrical conductor, one therefore needs electrical connectors that will ensure continuous shielding properties.

SUMMARY OF THE INVENTION

Accordingly, a primary object of the invention is to provide an electrical connector having a generally tubular housing connects the conductors of an electrically-shielded cable with an electrical component, including a injection-molded electrically-conductive synthetic plastic bridge arrangement connecting the cable shield layer at a stripped end of the cable with a connector shield member arranged on the connector housing into one end of which the conductors are introduced.

According to another object, an injection-molded annular carrier layer of insulating synthetic plastic material is molded concentrically about the conductor ends, one end of the carrier layer extending within the conductive bridging layer, and the other end extending within the bore of the connector housing into which the conductor ends extend.

Another object is to provide a method for producing such a connector including the conductive synthetic plastic bridge means.

A further object is to provide an electrical connector, which, in particular, will ensure in a vibration-susceptible environment a continuous and qualitatively high-grade shielding action and which furthermore can be produced in a simple fashion and at reasonable cost. Consequently, the connector is structurally reinforced to resist the forces and stresses of vibration and shock.

This problem is solved with an electrical connector for the connection of a cable with an electrical subassembly, whereby the cable has a conductor shield, whereby the connector includes a housing on which is arranged a housing shield, as well as an electrically conductive shield for the connection of the housing shield with the conductor shield, which comprises a first sleeve part as well as a second sleeve part, whereby at least the first sleeve part is injection-molded. Mating the first sleeve part by way of the injection-molding process offers the advantage that the first sleeve part will immediately come to rest against its neighboring parts during the injection-molding action. Even gaps between the parts are filled up during the injection-molding process at least partly from the first sleeve part. As a result, the first sleeve part endows the electrical connector at least in the area injection-molded all around by it not only with a very good stability, but it furthermore diminishes or prevents, at least in this area, a relative movement of the parts with respect to each other. Besides, in a heavily vibrating environment, there is therefore the danger that the screening might become loose as a result of the relative motion of the parts with respect to each other, and hence, diminished. Furthermore, the sleeve can be produced at very reasonable cost by means of the injection-molding process.

In a particularly preferred manner, at least the part of the sleeve resting against the conductor screen is injection-molded. In this way, we can make sure that the sleeve will securely contact the conductor shield. In particular, when the conductor shield is made of wire braid, then during the production of the sleeve, sleeve material will penetrate at least partly into intervals of the wire braid so that the connection between the sleeve and the conductor shield will be very strong and can be ensured also in the face of vibrations.

In a preferred embodiment, both sleeve parts are injection-molded individually together with each other. In this embodiment, the conductor shield and the housing shield are connected directly with each other by means of the individually injection-molded sleeve.

In a likewise preferred embodiment, the second sleeve part is a metal sleeve. The metal sleeve is preferably arranged between the housing shield and the first sleeve part and connects them electrically with each other. In this embodiment, the conductor shield and the housing shield are connected with each other by means of the metal sleeve and the injection-molded first sleeve part.

Preferably, the metal sleeve has a contact part with which it contacts the housing shield. Likewise in a preferred manner, the housing shield has a counter part which corresponds to the contact, and with that counter part, it contacts the metal sleeve. The contact part and the associated part, for example, are made as mutually corresponding collars that so engage each other that the contact of the housing shield to the metal sleeve will be ensured also in the face of vibrations.

The housing shield is preferably made as a housing nut. In this embodiment, it can be coupled in a very simple manner with a corresponding electrical connector by a threaded connection. The electrical connector preferably is provided as a plug and the corresponding electrical connector is provided as a socket, or vice versa.

The cable preferably comprises at least one electrical conductor, which is at least partially arranged in the housing. Likewise in a preferred manner, the cable comprises several electrical conductors, whereby the conductor shield will screen at least one or several, in particular, all conductors. The conductor or conductors are preferably electrically insulated, for example, by an electrically insulating casing, in particular, consisting of a synthetic plastic substance. In a preferred embodiment, the cable also has an electrically insulating cable sheath, in particular, consisting of a synthetic plastic material.

In a preferred embodiment, the electrical conductor has at least one conductor connection for the connection of the electrical conductor. Likewise in a preferred manner, the electrical conductor—optionally but not coercively—has an electronic unit that is connected to the electrical conductor, for example, a filter or a resistance.

The connector housing preferably extends in an axial direction, whereby the first sleeve part and/or the second sleeve part essentially are arranged coaxially around the axial direction. Preferably, the sleeve, the conductor screen, or the housing shield are closed circumferentially around the axial direction. In a furthermore preferred manner, the second sleeve part is arranged at least partly on the housing. The second sleeve, as well as the housing shield, therefore circumferentially enclose in the axial direction preferably in each case a part of the connector housing.

In a furthermore preferred manner, the electrical connector comprises an electrically insulating carrier layer that supports at least the first sleeve part. Likewise in a preferred manner, the carrier layer at least partly supports the second sleeve part. The carrier layer is preferably arranged coaxially around the electrical conductor or conductors and insulates them from the sleeve. In a particularly preferred manner, the carrier layer is arranged at least between the cable and the housing. In a likewise preferred manner, the carrier layer extends from the conductor screen to the housing and possibly at least partly into that housing. It is arranged especially in a manner resting on the housing and on the cable.

In a particularly preferred manner, the carrier is injection-molded. This facilitates the possible action: During its production, it will flow into intervals between several electrical conductors, between the housing and the electrical conductor or conductors and/or between the conductor shield and/or possibly between a cable sheath and the electrical conductor or conductors. Preferably, the carrier therefore encases the electrical conductor or conductors. In a preferred manner, it furthermore insulates also the connection of the electrical conductor or conductors with the conductor connections of the electrical connector from the sleeve. The carrier layer therefore also stabilizes the electrical conductor and prevents the relative motion of the structural parts that are adjacent to it or among each other.

In this embodiment, the sleeve preferably encases the carrier completely. In a particularly preferred manner, the carrier is completely encased by the first sleeve part.

The electrical conductor preferably furthermore includes comprises a grip member, which is arranged on the sleeve. The grip member is preferably provided in an electrically insulating manner. In a furthermore preferred fashion, it is arranged on the side of the sleeve facing away from the carrier and encases at least the first sleeve part and/or at least partially also the second sleeve part so that these parts will be protected against external factors, for example, mechanical stress, corrosion, or any further chemical influencing factors. In a preferred embodiment, the grip member is likewise injection-molded. In a particularly preferred manner, it is made from a synthetic plastic substance.

In the particular industrial area concerned, the inventive electrical conductor ensures a qualitatively high-grade and continuous screening action. It can furthermore be made rather cheaply.

The problem is furthermore solved with a process for the production of an especially inventive electrical connector that is provided for the connection of a cable with an electrical subassembly, whereby the cable comprises at least an electrical conductor and has a conductor shield produced by the following steps:

arranging the electrical conductor in a connector housing, arranging a housing shield on the connector housing, whereby the process comprises the following additional step:

injection-molding an electrically insulating carrier, at least between the housing and the cable, and injection-molding a first electrically conductive sleeve part.

Here, the housing shield is arranged on the connector housing as a function of the embodiment of the electrical conductor, preferably either before the injection-molding action of the electrically insulating carrier or thereafter.

In a first preferred embodiment, the process comprises either the further step of:

injection-molding a second sleeve part, in particular, individually with the first sleeve part, or in a second preferred embodiment, the next step:

arranging a second sleeve part on the housing.

In the latter case, the second sleeve part is arranged preferably before the arrangement of the housing screen on the housing.

Preferably, the process comprises the final step:

injection-molding a grip member.

The process can be implemented at reasonable cost and in an automated fashion and ensures the connection of the conductor screen with the housing screen. Therefore, it facilitates the production of prefabricated cables with inventive electrical connectors that display a qualitatively high-grade continuous screening effect.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
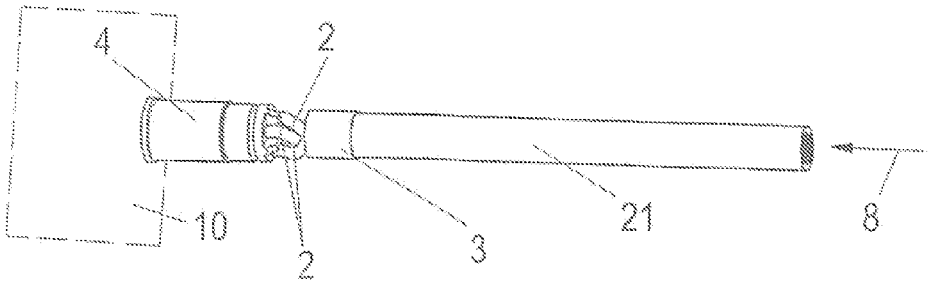
FIGS. 1*a*-1*d* are perspective views illustrating the steps for connecting the shielded cable to a connector housing.
Figure 1B:
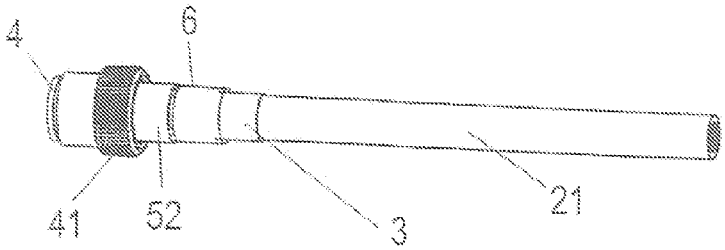
Figure 1C:
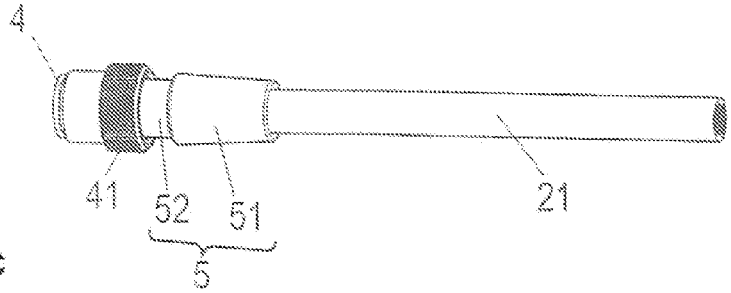

Referring first more particularly to FIGS. 1*a*-1*e*, the electrical connector 1 of the present invention is provided for connecting a shielded cable 21 with an electrical subassembly 10, which is indicated here only schematically. An electrical subassembly 10, for example, is an electrical unit, in particular, a transmitter or receiver, a printed circuit board, or another electrical device. For the connection of cable 21 with electrical subassembly 10, the latter has a part that is to be connected, for example, an additional inventive electrical connector 1.

In this embodiment, cable 21 has three electrically insulated conductors 2 as well as one conductor shield 3, whereby conductor shield 3 shields the three electrical conductors 2 against electromagnetic radiation. Electrical conductors 2 are arranged in a first production step in a generally tubular electrically-insulating connector housing 4 of electrical connector 1, whereby conductor screen 3 is preferably exposed by stripping off the outer insulation layer of the conductor. For this, conductor connections (not shown) are provided in housing 4. As conductor connections, we can consider here, for example, screwing or crimping connections (not shown). To connect the electrical conductors 2 with the conductor connections, they are stripped of their insulation, and the bare ends are crimped or fastened to the corresponding pins or sockets. Housing 4 is here formed made as a snap-in plug connector.

Subsequently, a second sleeve part 52, which here is made as a metal sleeve, is arranged on housing 4. The second sleeve 52 has a collar 521 (see FIG. 2) that serves as a contact part to the housing shield 41. Housing shield 41 is arranged on housing 4 after the arrangement of the second sleeve part 52 specifically in such a manner that a counter collar part 521 (see FIG. 2) will come to rest on the collar and will connect the second sleeve part 52 electrically with housing shield 41. Housing shield 41 is here made as a housing nut. It is intended for routing the screening on to the electrical subassembly 10.

Subsequently thereto, an annular carrier layer 6 is injection-molded and in the embodiment shown here extends from conductor shield 3 all the way up to housing 4 and into the bore of the latter. Here, housing shield 41, conductor shield 3, the second sleeve part 52, as well as carrier layer 6 are arranged essentially coaxially arranged relative to the longitudinal axis of the connector housing 4, which is shown as arrow 8 in FIG. 1*a*. Carrier layer 6 is injection molded from an made electrically insulating synthetic plastic material, so that it will insulate the electrical conductors 2 as well as the conductor connections (not shown) from the conductor shield, and so that it will insulate them electrically from the second sleeve part 52, see FIG. 1*b*.

Besides, carrier layer 6 insulates conductors 2 also from a first sleeve part 51, which is subsequently injection-molded so as to rest against the carrier layer 6. The first sleeve part 51 is injection molded from an electrically conducting synthetic plastic material. It extends likewise coaxially in the extent direction 8 and connects the conductor shield 3 with the second sleeve part 52 and thus also with housing shield 41. Therefore, in this embodiment, the injection-molded first sleeve part 51 and second sleeve part 52, which is made as metal sleeve, will form a sleeve unit 5 that will continually connect conductor shield 3 with housing shield 41 of electrical connector 1, see FIG. 1*c*.

Figure 1D:
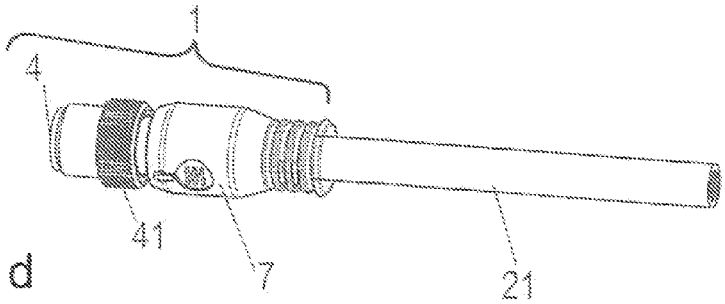

Finally, a grip member 7 is formed by injection molding from an electrically-insulating synthetic plastic material, which grip member completely encases at least the first sleeve part 51 of sleeve unit 5 in order to protect the latter against external factors such as chemical or mechanical stress, see FIG. 1*d*. Grip member 7 is made from an electrically insulating synthetic plastic material, for example, polyurethane. When the inventive electrical connector 1 is used within a machine, the grip member can possibly be omitted.

Figure 2:
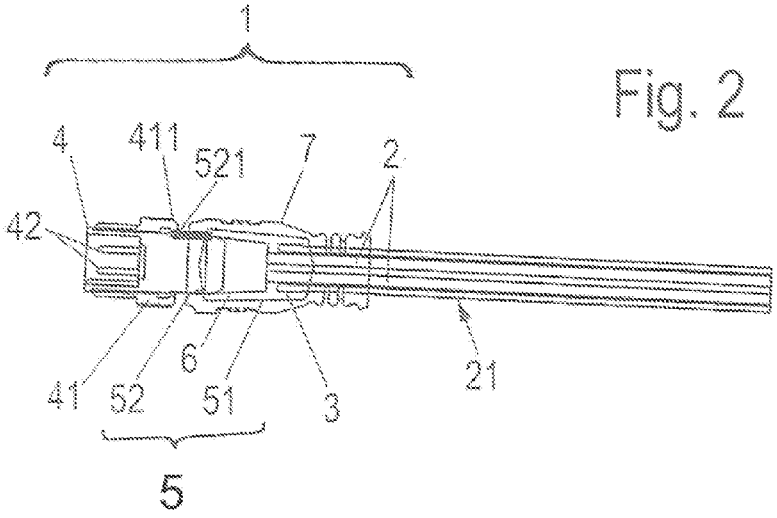
FIG. 2 is a sectional view of the finished completely assembled connector of FIG. 1*d;*

FIG. 2 is a sectional view of the electrical connector 1 from FIG. 1. In the embodiment shown here, housing 4 has pin contacts 42 so that this electrical connector 1 will be a plug. Housing screen 41 is made as housing nut and has a collar-like counter part 411 for the contacting of a collar-like contact part 521 of the second sleeve 52.

Figure 3:
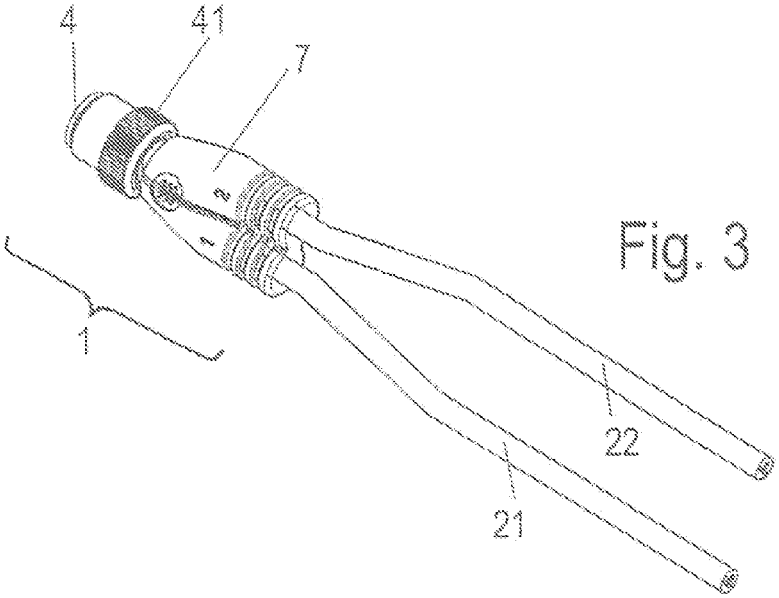
FIG. 3 is a perspective view of a second embodiment of the invention.

FIG. 3 shows an embodiment of electrical conductor 1 as Y-connector. In the embodiment shown here, two cables, 21, 22, are guided into the electrical connector 1; both of these cables in each case have one or several electrical conductors 2 (not visible here, see FIGS. 1 and 2). At least one or several electrical conductors 2 or one or both cables 21, 22 have a conductor screen 3 (see FIGS. 1 and 2), whereby the conductor shields 3 are connected with housing shield 41 in an electrically conductor manner by means of sleeve 5 (see FIGS. 1 and 2).

Figure 4A:
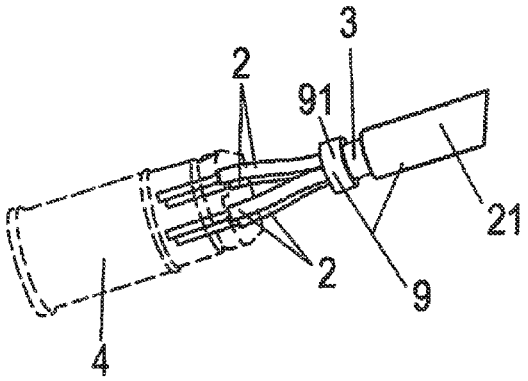
FIGS. 4*a*-4*c* are perspective views illustrating the steps for producing another embodiment of the invention.
Figure 4B:
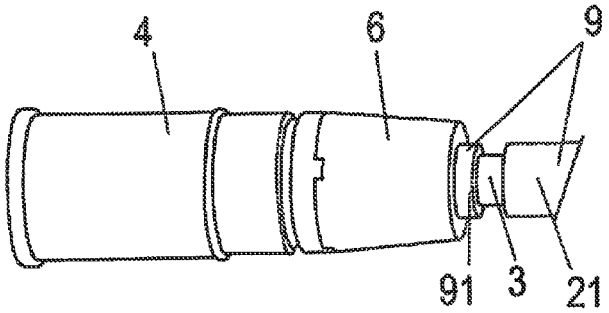
Figure 4C:
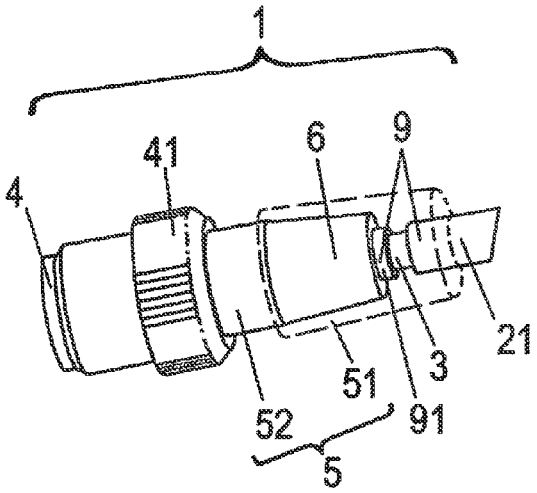

FIG. 4 shows yet another embodiment of electrical connector 1. In contrast to the embodiment shown in FIG. 1, cable 21 here has four electrical conductors 2 and one cable sheath 9. Conductor shield 3 is arranged for the screening of all electrical conductors 2 on the side of the cable sheath 9 facing toward electrical conductors 2. Therefore, conductor shield 3 must be exposed prior to the injection-molding of carrier 6 and/or of sleeve 5, respectively, of the first sleeve part 51.

For this purpose, cable sheath 9 is cut especially automatically, for example, during a process adjusting the length of cable 21. Here, it is preferable to strip a piece 91 of cable sheath 9 partly from the conductor shield 3, see FIG. 4*a*. Alternatively, a piece 91 of cable sheath 9 is removed completely from conductor shield 3, or, a piece 91 of cable sheath 9 is not at all removed. In this case, the cable sheath 9 is merely cut particularly peripherally in such a manner that conductor screen 3 will not be damaged in the process.

The advantage of this conductor preparation resides in the fact that the sealing diameter of carrier 6 is defined and is round, and specifically it corresponds either to the cable sheath diameter when piece 91 of cable sheath 9 is removed only partially or not at all from conductor shield 3 or conductor shield diameter when piece 91 of cable sheath 9 is removed from conductor screen 3. As a result, the pre-casting process can be accomplished in a very secure fashion.

Likewise in this embodiment, sleeve 5 is made from an injection-molded first sleeve part 51 and a second sleeve part 52. The second sleeve part 52, for example, is made as a metal sleeve, or it is made from a synthetic substance, and it is electrically conductive.

During the injection-molding at least of the first sleeve part 51 and possibly of the second sleeve part 52, both of them are assembled simultaneously, and the electrical connection is established between conductor screen 3 and housing screen 41.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector (1) for connecting to an electrical component (10) the conductors of an electrically-shielded cable, comprising:

(a) a cable (21) having:

(a) a tubular outer sheath of synthetic plastic insulating material, said outer sheath having a first end;

(b) a conductive braided-wire cable shield (3) arranged concentrically within said outer sheath; and (c) a plurality of insulated conductors (2) arranged within said cable shield, said conductors and said cable shield extending in exposed relation longitudinally outwardly from said outer sheath first end;

(b) a tubular connector housing (4) having a first end adapted for connection with the electrical component, said housing having a second end into which said conductors are inserted;

(c) an annular carrier layer of insulating material (6) injection-molded concentrically about, and in supporting engagement with, the exposed portions of said conductors, one end portion of said second carrier layer extending within said connector housing second end;

(d) a conductive annular connector housing shield (41) arranged concentrically about said connector housing; and (e) electrically-conductive bridge means (5) electrically connecting the exposed portion of said cable shield with said connector housing shield, said bridge means including:

(1) an injection-molded first annular sleeve (51) of conductive synthetic plastic material having a first end in contiguous concentric molded engagement with said cable shield: and (2) a tubular conductive second sleeve (52) connecting the other end of said injection-molded first sleeve with said connector housing shield, said tubular second sleeve having a collar portion (411) arranged concentrically relative to a corresponding collar portion (511) of said connector housing shield.

2. An electrical connector as defined in claim 1, and further including an annular grip member (7) arranged concentrically about said bridge means.

3. An electrical connector as defined in claim 2, wherein said grip member is formed from injection-molded synthetic plastic insulating material.

4. An electrical connector as defined in claim 1, wherein said connector housing shield comprises a nut member (41) threadably connected with said connector housing.

5. An electrical connector as defined in claim 1, wherein a circumferential intermediate portion adjacent said one end (91) of said cable sheath is stripped to expose a second portion said cable shield, said first sleeve portion being in molded conductive engagement with said second shield portion.

6. A method for assembling to a tubular electrical connector housing (4) having a connector shield (41) a cable (21) having an outer insulating sheath containing a tubular braided-wire cable shield (3) arranged concentrically about a plurality of insulated conductors (2) that extend with said cable shield from one end from said sheath, which comprises the steps of:

(a) introducing the conductor ends into one end of said connector body;

(b) injection-molding a first annular carrier layer (6) of insulating material concentrically about said conductors, a portion of said carrier layer extending at one end between said conductors and into the adjacent end of said connector body;

(c) injection-molding a first annular bridging layer (51) of electrically-conducting synthetic plastic material concentrically about said first carrier layer of insulating material, said first bridging layer being in molded concentric engagement at one end with said cable shield extending portion; and (d) electrically connecting by second bridge means (52) the other end of said electrically-conductive first annular bridging layer with said connector shield.

7. A cable assembling method as defined in claim 6, and further including the step of:

(e) injection molding a grip member (7) from synthetic plastic material concentrically about said first bridging layer of conductive synthetic plastic material.

8. A cable assembling method as defined in claim 6, and further including the preliminary step of stripping a circumferential portion of the cable sheath adjacent said cable sheath one end (91) to expose a corresponding second portion of the cable shield, said first bridging sleeve being in molded engagement with said second exposed cable shield portion.

* * * * *